US010508441B2

(12) United States Patent
Kopish et al.

(10) Patent No.: US 10,508,441 B2
(45) Date of Patent: Dec. 17, 2019

(54) DEMOUNTABLE WALL SYSTEM

(71) Applicant: Krueger International, Inc., Green Bay, WI (US)

(72) Inventors: Andrew J. Kopish, Green Bay, WI (US); Nathan A. Quintal, DePere, WI (US); Timothy John LaFleur, Menasha, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 16/045,037

(22) Filed: Jul. 25, 2018

(65) Prior Publication Data

US 2018/0328031 A1 Nov. 15, 2018

Related U.S. Application Data

(63) Continuation-in-part of application No. 13/754,417, filed on Jan. 30, 2013, now Pat. No. 10,053,858.
(Continued)

(51) Int. Cl.
*E04B 2/82* (2006.01)
*E04B 2/74* (2006.01)
(Continued)

(52) U.S. Cl.
CPC ..... *E04B 2/74* (2013.01); *E04F 21/1877* (2013.01); *E05D 15/063* (2013.01); *E05D 15/28* (2013.01);
(Continued)

(58) Field of Classification Search
CPC ..... E04B 2002/749; E04B 2002/7483; E04B 2002/7487; E04B 2002/7462;
(Continued)

(56) References Cited

U.S. PATENT DOCUMENTS 3,140,565 A 7/1964 Ward
3,453,790 A 7/1969 Harris
(Continued)

FOREIGN PATENT DOCUMENTS

WO 2011137530 A1 11/2011
WO 2014039278 A1 3/2014

OTHER PUBLICATIONS

Canadian Office Action for Canadian Patent Application No. 2,804,654 dated Sep. 18, 2014.
(Continued)

*Primary Examiner* — Chi Q Nguyen
(74) *Attorney, Agent, or Firm* — Andrus Intellectual Property Law, LLP

(57) ABSTRACT

A demountable modular wall system for a building having a floor and a ceiling. The system includes panels having a top end and a bottom end with a movement direction defined perpendicularly therebetween. A height adjustment mechanism is positioned between the bottom end of one of the panels and the floor. The height adjustment mechanism has a mounting bracket that sandwiches the bottom end of the one of the panels. The height adjustment mechanism includes a receiving cylinder that threadingly engages with a first member. The first member also threadingly engages with a second member positioned between the first member and the floor. The first member is moveable relative to the receiving cylinder in the movement direction such that rotation of the first member selectively adjusts the height of the one of the panels.

20 Claims, 9 Drawing Sheets

Related U.S. Application Data

(60) Provisional application No. 61/593,370, filed on Feb. 1, 2012.

(51) Int. Cl.
*E04F 21/18* (2006.01)
*E05D 15/28* (2006.01)
*E05D 15/06* (2006.01)

(52) U.S. Cl.
CPC ... *E05Y 2800/672* (2013.01); *E05Y 2900/132* (2013.01)

(58) Field of Classification Search
CPC .. E04B 2/7425; E04B 2/82; E04B 2002/7492; E04B 2002/7494; E04B 2/967; E04B 2/7455; E05Y 2900/132; E06B 3/5864; E06B 3/585; E06B 3/5878; E06B 3/60; E06B 1/6076; Y10T 403/7062; Y10T 403/7067
USPC ..... 52/126.4, 235, 238.1, 239, 241, 242, 52/243.1, 36.1, 308, 656.1, 204.1, 204.5, 52/656.5, 204.71, 206, 767, 204.65, 52/584.1, 800.1, 800.18; 411/535, 546; 403/374.3, 373
See application file for complete search history.

(56) References Cited

U.S. PATENT DOCUMENTS

| | | | |
|---|---|---|---|
| 3,593,475 | A | 7/1971 | Lague |
| 3,653,156 | A | 4/1972 | Horgan, Jr. |
| 4,128,983 | A | 12/1978 | Matsubara |
| 4,407,101 | A | 10/1983 | Propst et al. |
| 4,418,506 | A | 12/1983 | Weber et al. |
| 4,453,346 | A | 6/1984 | Powell et al. |
| 4,555,880 | A | 12/1985 | Gzym et al. |
| 4,574,547 | A | 3/1986 | Menchetti et al. |
| 4,578,913 | A | 4/1986 | Eich |
| 4,667,450 | A | 5/1987 | Stefnik et al. |
| 4,891,920 | A | 1/1990 | Pingston |
| 5,233,803 | A | 8/1993 | Bockmiller |
| 5,592,795 | A | 1/1997 | Rinehart et al. |
| 6,016,632 | A | 1/2000 | McGee et al. |
| 6,058,665 | A | 5/2000 | Halvorson, Jr. et al. |
| 6,141,923 | A | 11/2000 | Habicht et al. |
| 6,397,533 | B1 | 6/2002 | Hornberger et al. |
| 6,658,805 | B1 | 12/2003 | Yu et al. |
| 6,820,388 | B2 | 11/2004 | Newhouse et al. |
| 6,988,344 | B1 | 1/2006 | Krueger |
| 7,568,311 | B2 | 8/2009 | Shivak et al. |
| 8,011,146 | B2 | 9/2011 | Krause |
| 8,024,901 | B2 | 9/2011 | Gosling et al. |
| 8,601,749 | B2 | 12/2013 | Von Hoyningen Huene et al. |
| 8,613,168 | B2 | 12/2013 | Von Hoyningen Huene et al. |
| 8,615,936 | B2 | 12/2013 | Von Hoyningen Huene et al. |
| 9,234,345 | B1 | 1/2016 | O'Keeffe |
| 10,053,858 | B2 * | 8/2018 | Kopish ..... E05D 15/063 |
| 2002/0121056 | A1 | 9/2002 | Von Hoyningen Huene et al. |
| 2003/0089057 | A1 | 5/2003 | Wiechecki et al. |
| 2004/0020137 | A1 | 2/2004 | Battey et al. |
| 2005/0284094 | A1 | 12/2005 | Long et al. |
| 2006/0185250 | A1 | 8/2006 | Gosling et al. |
| 2010/0293882 | A1 | 11/2010 | Labrecque et al. |
| 2011/0099929 | A1 | 5/2011 | Liegeois et al. |
| 2012/0317899 | A1 | 12/2012 | Von Hoyningen Huene et al. |
| 2014/0157720 | A1 | 6/2014 | Von Hoyningen Huene et al. |

OTHER PUBLICATIONS

Canadian Office Action for Canadian Patent Application No. 2,804,654 dated Mar. 18, 2015.
FARAM P650 Catalog, Jan. 2009.

* cited by examiner

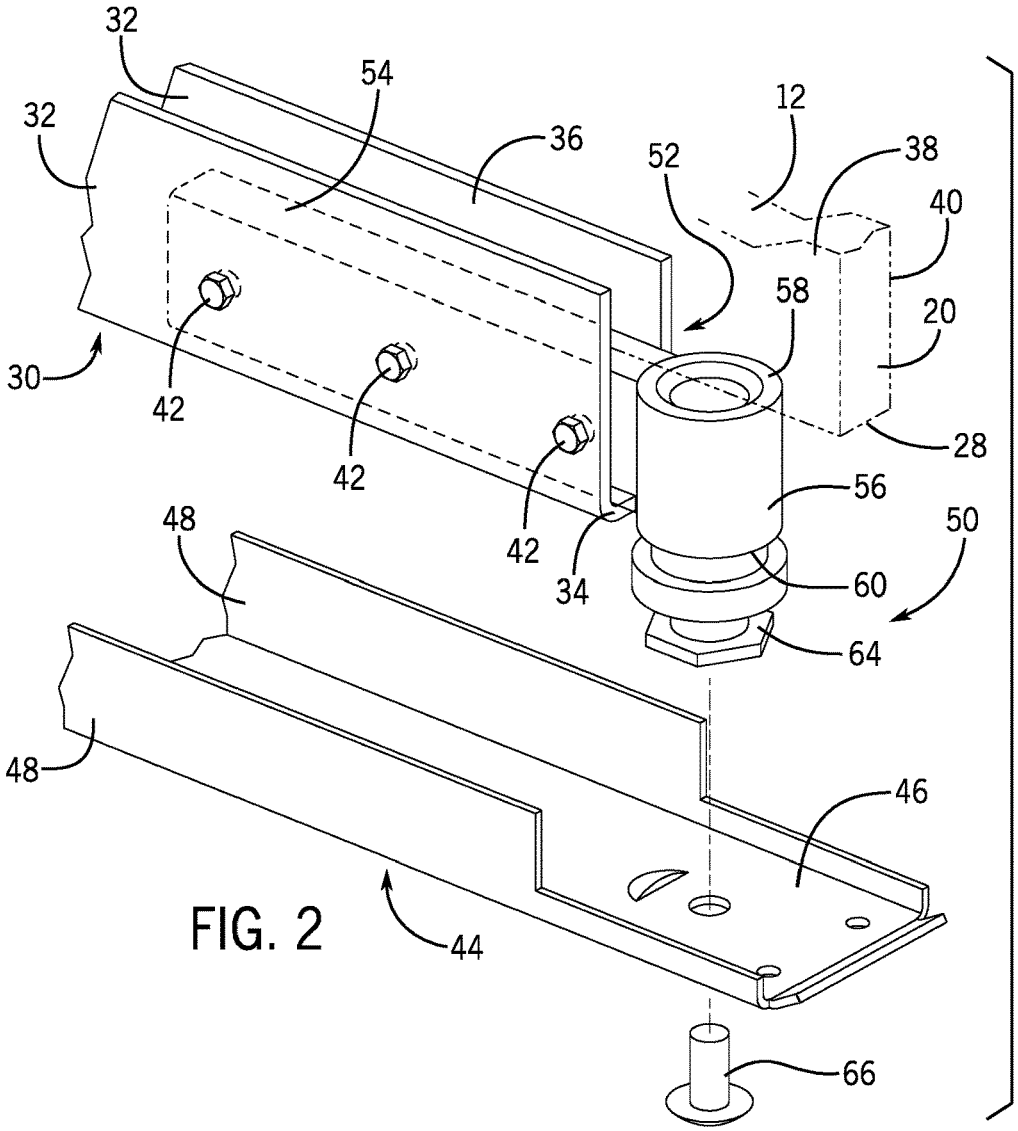
FIG. 2
FIG. 3
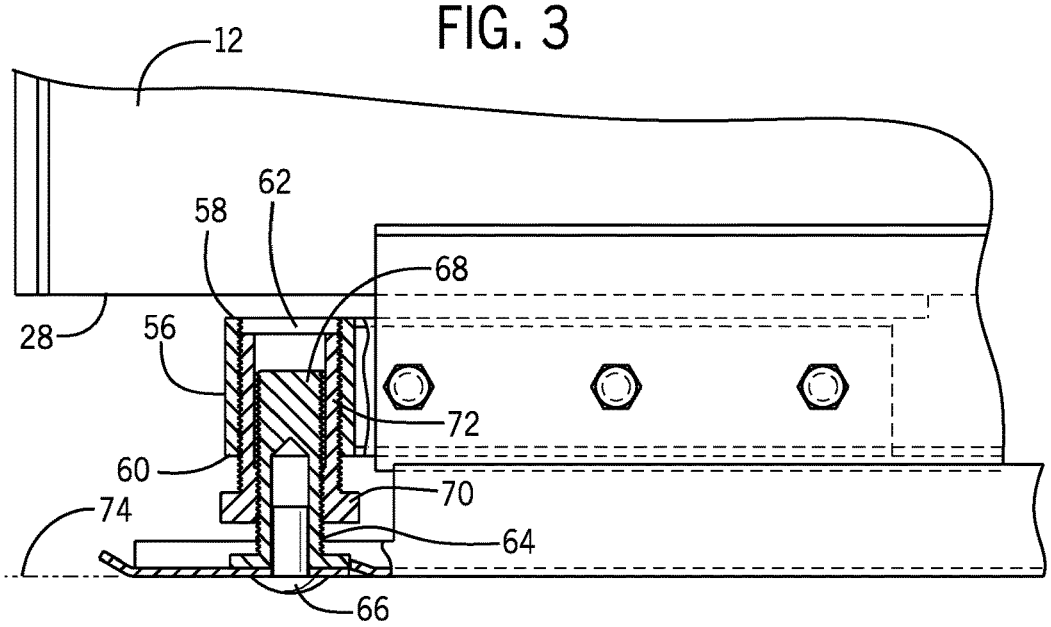

DEMOUNTABLE WALL SYSTEM

CROSS-REFERENCE TO RELATED APPLICATION

The present application is a continuation-in-part of U.S. patent application Ser. No. 13/754,417, filed on Jan. 30, 2013, and granted as U.S. Pat. No. 10,053,858, which claims priority to U.S. Provisional Patent Application Ser. No. 61/593,370 filed on Feb. 1, 2012.

BACKGROUND

The present disclosure generally relates to a wall panel system. More specifically, the present disclosure relates to a demountable wall system (DWS) that uses tempered or laminated glass as the primary exposed surface and the primary structural element.

Panel-type wall systems are commonly used to divide space in an open-plan office environment. In a typical modular panel-type wall system, a number of wall panels are interconnected together in a configuration suitable for the intended use of the space. Each wall panel typically includes a structural frame to which a pair of tiles are mounted. The tiles may be broadly classified as either decorative tiles or functional tiles. Decorative tiles have an acoustic insulating material covered by an appropriate finishing material such as fabric, metal or wood and are designed to provide sound proofing and aesthetic appearance. Functional tiles generally have a tile frame that supports functional components, such as a tool rail, one or more hooks, an opening, a window, a shelf, a marker board, paper management components, etc.

The large number of panel-type wall systems currently available allow a business owner to divide an open space into a series of enclosed areas. Although panel-type wall systems are commonly available, the solid surfaces used in most panel systems create an enclosed area that may not have any exterior windows or any other types of glass areas open to allow light to enter into the enclosed area.

Presently, modular wall systems have been developed that include glass panels as the structural elements rather than just as windows within a typical panel system. The demountable wall systems that use tempered or laminated glass as the primary exposed surface increase the amount of light that reaches into the enclosed area defined by the wall panel. However, utilizing glass panels instead of solid, structural panels creates certain challenges since structural components of the panel systems are viewable through the glass panel members.

SUMMARY

The present disclosure generally relates to a wall panel system that includes a series of glass wall panels that can be selectively oriented in a desired configuration. The demountable modular wall system includes a series of individual components that allow the wall panel system to be configured and reconfigured as desired.

The demountable modular wall system includes a series of individual glass panels that each have a top end, a bottom end and a pair of spaced side edges. Each of the individual glass panels is configured to extend between a floor and a ceiling of a building that is divided into areas or sections by the wall system.

Each of the individual glass panels includes a panel height adjustment mechanism that is positioned between the bottom end of each panel and the floor. Preferably, each panel height adjustment mechanism is positioned on each of the spaced sides of the wall panel. Each of the panel height adjustment mechanisms can be independently adjusted to adjust the orientation and height of the individual glass panels.

One embodiment of the present disclosure generally relates to a demountable modular wall system for use in a building having a floor and a ceiling. The system includes a series of individual panels each having a first side, a second side, a top end, and a bottom end. A movement direction is defined perpendicularly from the bottom end to the top end. A height adjustment mechanism is positioned between the bottom end of one of the individual panels and the floor. The height adjustment mechanism has a mounting bracket with a first member flange and a second member flange that together sandwich the bottom end of the one of the individual panels. The height adjustment mechanism includes a receiving cylinder that threadingly engages with a first member. The first member also threadingly engages with a second member positioned between the first member and the floor. The first member is moveable relative to the receiving cylinder in the movement direction such that rotation of the first member selectively adjusts the height of the one of the individual panels. An upper trim is positioned between the top end of each of the individual panels and the ceiling and a lower trim positioned between the bottom end of each of the individual panels and the floor. The upper and lower trim are stationary relative to the individual panels.

Another embodiment of the present disclosure generally relates to a demountable modular wall system for use in a building having a floor and a ceiling. The system includes a series of individual panels each having a first side, a second side, a top end, and a bottom end. A movement direction is defined perpendicularly from the bottom end to the top end. A pair of height adjustment mechanisms is provided for each of the individual panels with each of the height adjustment mechanisms being positioned between the bottom end of one of the individual panels and the floor. Each of the height adjustment mechanisms has a mounting bracket with a first member flange and a second member flange that together sandwich the bottom end of the one of the individual panels. Each of the height adjustment mechanisms includes a receiving cylinder that threadingly engages with a first member. The first member also threadingly engages with a second member positioned between the first member and the floor. The first member is moveable relative to the receiving cylinder in the movement direction such that rotation of the first member selectively adjusts the height of the one of the individual panels, where each of the height adjustment mechanisms is independently adjustable. An upper trim is positioned between the top end of each of the individual panels and the ceiling, and a lower trim positioned between the bottom end of each of the individual panels and the floor. The upper and lower trim are stationary relative to the individual panels.

Another embodiment of the present disclosure generally relates to a demountable modular wall system for use in a building having a floor and a ceiling. The system includes two individual panels each having a first side, a second side, a top end, and a bottom end. A movement direction is defined perpendicularly from the bottom end to the top end and a plane is defined to be parallel to the first side. The system includes four height adjustment mechanism with two of the fourth height adjustment mechanisms being positioned between the bottom end of a first of the two individual panels and the floor. The two of the four height adjustment mechanisms each have a mounting bracket with a first member flange and a second member flange that together sandwich the bottom end of the first of the two individual panels. The four height adjustment mechanisms each include a double jack screw having a first member threadedly engaged with a second member that is coaxially aligned with the first member such that the double jack screw is extendable parallel to the movement direction by rotation of the first member to selectively adjust the height of one of the two individual panels. An upper trim is positioned between the top end of each of the two individual panels and the ceiling and a lower trim is positioned between the bottom end of each of the two individual panels and the floor. The upper and lower trim are stationary relative to the two individual panels. Each of the four adjustment mechanisms is independently adjustable, and the height of each of the two individual panels is independently adjustable.

Another embodiment of the present disclosure generally relates to a demountable modular wall system for use in a building having a floor and a ceiling. The system includes a plurality of panels each having a top end and a bottom end. A top channel guide defines an open passageway for receiving the top end of one of the panels to be securely attached thereto, where the top channel guide comprises a first portion and a second portion that are rotatable coupled via a rotatable locking feature to define the open passageway therebetween. The top channel guide is rotatable between an open state and a closed state in which the open passageway is narrower than in the open state. The top channel guide is securely attached to the one of the panels when the one of the panels is received within the open passageway and the top channel guide is in the closed state.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 2 is a magnified view of one of the panel height adjustment mechanisms used to adjust the height of the wall panel from a floor;

FIG. 3 is a partial section view of the panel height adjustment mechanism shown in FIG. 2;

DETAILED DESCRIPTION

Figure 1:
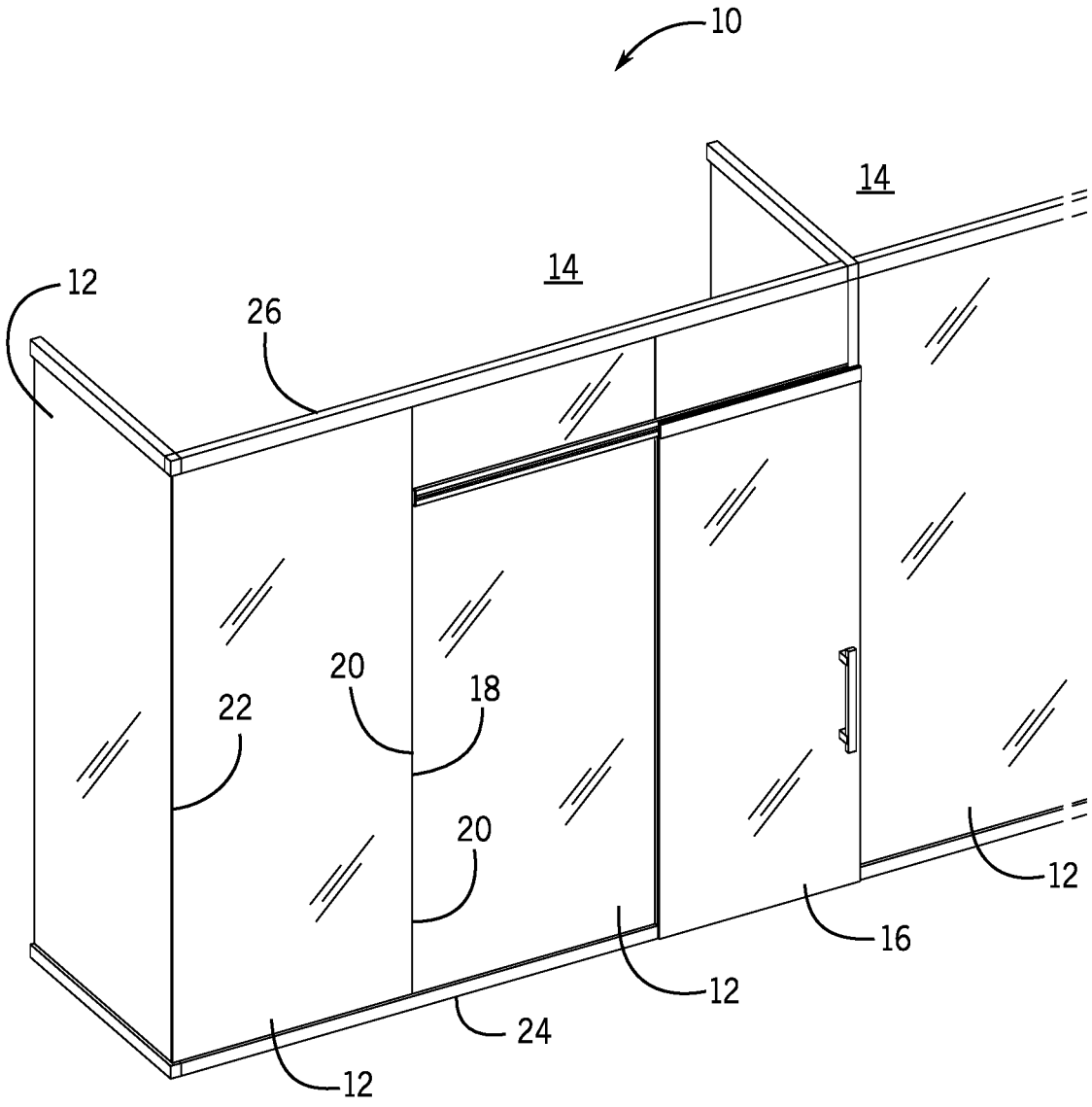
FIG. 1 is a perspective view of a demountable wall system of the present disclosure.

FIG. 1 illustrates a demountable wall system (DWS) 10 constructed in accordance with the present disclosure. The wall system 10 shown in FIG. 1 includes multiple glass panels 12 that can be used with conventional solid wall panels or with each other to create multiple rooms 14.

In the embodiment shown in FIG. 1, the wall system 10 includes a sliding door 16 that can be used to selectively expose a doorway to enter into one of the rooms 14. In the embodiment shown in FIG. 1, the adjacent wall panels 12 abut each other to create a panel joint 18. In the embodiment illustrated, the panel joint is a butt-glazed joint in which one of the side edges 20 of the adjacent wall panels 12 includes a bulb seal that creates a seal between the pair of adjacent wall panels at the panel joint 18. In addition, one of the pair of wall panels 12 that define the corner 22 also include a bulb seal to create the joint between the pair of walls positioned at a 90° angle relative to each other.

As illustrated in FIG. 1, the demountable wall system 10 includes a lower trim 24 and an upper trim 26 that enhance the overall aesthetic appearance of the demountable wall system 10. In the embodiment shown in FIG. 1, both the lower trim 24 and the upper trim 26 are continuous sections that extend across multiple glass wall panels 12. The upper and lower trim sections 24, 26 are installed after the construction of the demountable wall system and provide a visually appealing appearance for the wall system 10.

Referring now to FIG. 2, each of the glass wall panels 12 includes a bottom end 28 and a pair of side edges 20, only one of which is shown in FIG. 2. The bottom end 28 of each wall panel 12 is received within a bottom rail 30. The bottom rail 30 includes a pair of vertical support flanges 32 that are joined to each other by a bottom wall 34 to define an open receiving cavity 36 sized to receive the glass wall panel 12. The support flanges 32 contact one of the two face surfaces 38, 40 of the glass wall panel 12. In the embodiment shown in FIG. 2, the bottom rail 30 is clamped onto the bottom end 28 of the glass wall panel 12 through a series of fasteners 42.

As illustrated in FIG. 2, a floor channel 44 is used as part of the demountable wall system 10 and is securely attached to the floor of a building. The floor channel 44 includes a generally flat base 46 and a pair of upstanding sidewalls 48. The floor channel 44 is mounted to the floor of a building and provides a secure point of attachment and stability for the individual glass panels 12. The floor channel 44 is a continuous component that extends beneath a single wall panel. A series of floor channels can be connected together to generally define the configuration of the walls to be constructed utilizing the multiple glass panels.

Since the floor of a building may not be level, the wall panel system of the present disclosure includes a series of panel height adjustment mechanisms 50 that allow the height of each of the glass wall panels 12 to be independently adjusted to create an even wall. A panel height adjustment mechanism 50 is positioned at each side of the wall panel such that the opposite sides of the wall panel can be independently adjusted to compensate for an uneven floor. Each of the panel height adjustment mechanisms 50 includes a mounting bracket 52 that is securely held within the bottom rail 30 by the series of fasteners 42. The mounting bracket 52 includes an attachment bar 54 attached to a receiving cylinder 56. The receiving cylinder 56 extends between a top end 58 and a bottom end 60. As best shown in FIG. 3, the receiving cylinder 56 includes an internally threaded open interior 62.

The panel height adjustment mechanism 50 shown in FIG. 2 is essentially a double jack screw that allows the overall height of the wall panel 12 to be adjusted while minimizing the fully retracted sides of the adjustment mechanism 50. The double jack screw includes a stud 64 that is stationary and attached to the floor channel 44 by fastener 66. As illustrated in FIG. 3, the fastener 66 prevents the stud 64 from rotating. The stud 64 includes a shaft 68 having external threads. The external threads of the shaft 68 are received within an internally threaded open interior of an upper jack screw 70. The upper jack screw 70 also includes an externally threaded shaft 72 that is threaded in the opposite hand from the stud 64. The shaft 72 is received by the internally threaded open interior 62 of the receiving cylinder 56.

As can be understood in FIG. 3, the height of the bottom end 28 of the wall panel 12 above the floor 74 can be modified by rotating the upper jack screw 70. Because the threads on the stud 64 and the upper jack screw 70 are opposite handed, rotation of the upper jack screw 70 results in both the movement of the upper jack screw 70 along the shaft 68 of the threaded stud 64 and the movement of the receiving cylinder 56 along the shaft 72 of the upper jack screw 70. This double threaded arrangement of the panel height adjustment mechanism 50 creates a total stroke that is greater than twice the height of the adjustment mechanism when completely retracted. This configuration allows for a greater range of motion while minimizing the size of the panel height adjustment mechanism 50.

Figure 4:
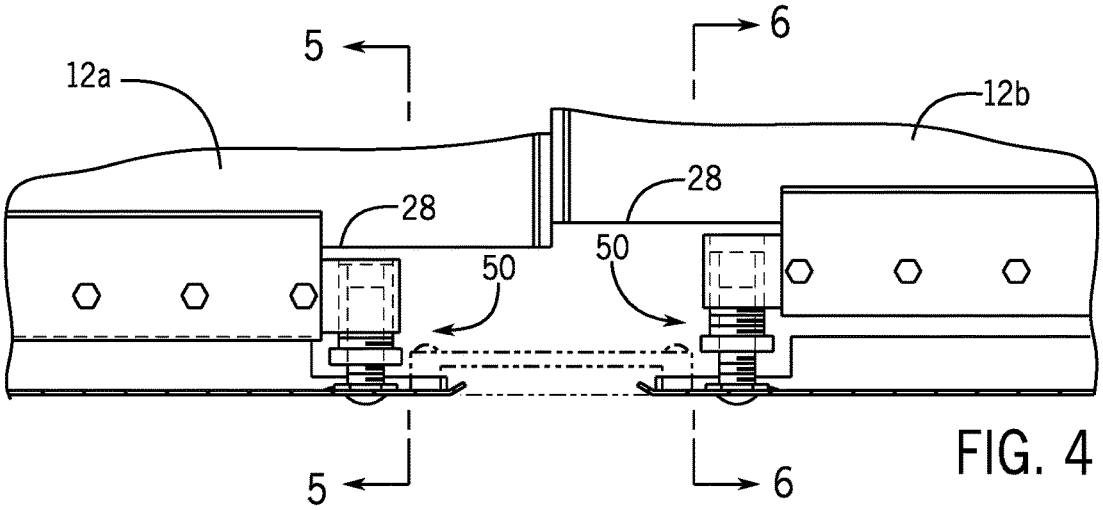
FIG. 4 is a schematic illustration of the adjustment of adjacent panels through utilization of the panel height adjustment mechanism.

FIG. 4 illustrates the independent adjustment of a first wall panel 12*a* relative to a second wall panel 12*b*. The independent adjustment between the two wall panels 12*a*, 12*b* allows the demountable wall system of the present disclosure to be independently adjusted when the floor of a building is not level. In the embodiment shown in FIG. 4, the bottom ends 28 of the adjacent wall panels 12*a*, 12*b* do not align with each other after each of the pair of panel adjustment mechanisms 50 have been adjusted.

Figure 5:
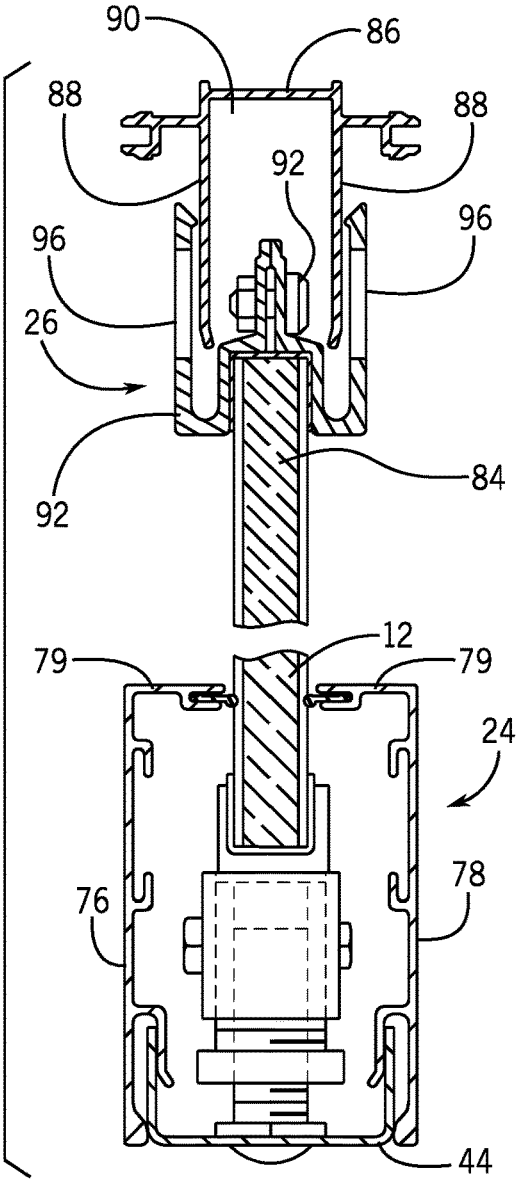
FIG. 5 is a section view taken along line 5-5 of FIG. 4.
Figure 6:
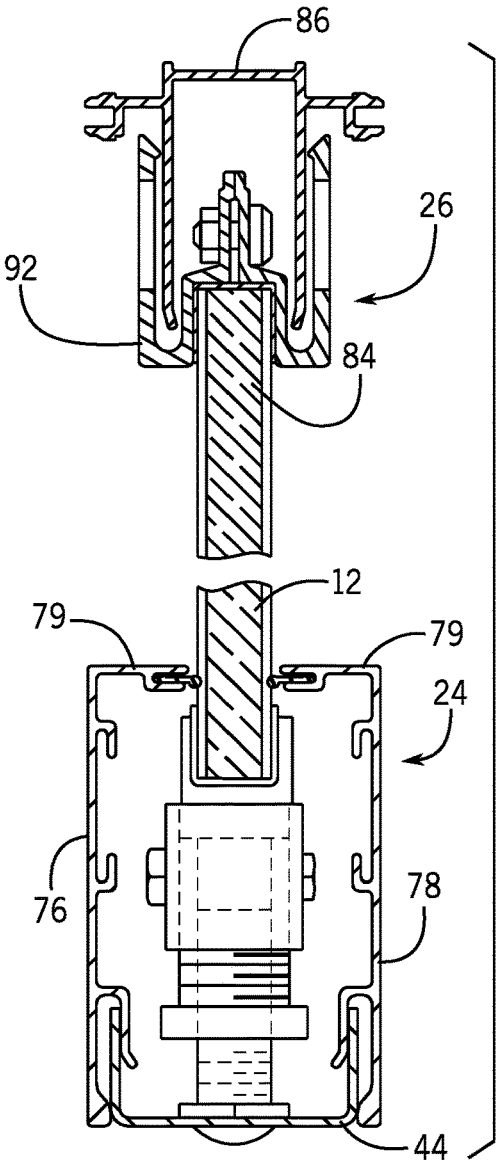
FIG. 6 is a section view taken along line 6-6 of FIG. 4.

As is illustrated in FIGS. 5 and 6, the lower trim 24 and the upper trim 26 create an overall smooth appearance for the trim sections. As illustrated in FIGS. 5 and 6, the lower trim 24 includes a first section 76 and a second section 78 that are each stationary and mounted to the floor channel 44. Each of the first and second sections 76, 78 includes a horizontal flange 79 that supports wiper 77 that contacts one of the faces of the wall panel 12.

Since the lower trim 24 covers the panel height adjustment mechanism 50, the panel height adjustment mechanism 50 is used to adjust the height of each of the panels 12 prior to the attachment of the lower trim 24.

In addition to the lower trim 24, each of the wall panels includes an upper trim 26 that also allows for movement of the top end 84 of the glass wall panel 12 relative to the stationary top trim 26. As shown in FIG. 5, a ceiling channel 86 is securely mounted to the ceiling of the building. The ceiling channel 86 may be mounted to the ceiling of a building utilizing various different attachment techniques, such as screws or other types of fasteners. The ceiling channel 86 is thus stationary relative to the adjustable glass wall panel 12. The ceiling channel 86 includes a pair of depending flanges 88. The flanges 88 are spaced by an open passageway 90 that can receive a portion of the top end 84 of the wall panel 12 during the adjustment of the wall panel 12.

The wall panel 12 further includes a top guide channel 92 that is securely attached to the top end 84 of the wall panel 12 utilizing various different types of attachment techniques. In the embodiment shown, a fastener 94 is used to clamp the top guide channel 92 in place. A flexible material or adhesive can be positioned between the top guide channel 92 and the top end 84 to further aid in attachment of the top guide channel 92 to the wall panel 12. The top guide channel 92 includes a pair of vertically extending side arms 96 that each move along the vertical flanges 88 of the ceiling channel 86. As can be understood in the comparison of FIGS. 5 and 6, the movement of the side arms 96 along the flanges 88 allow for vertical movement of the wall panel 12 while preventing separation of the panel from the ceiling channel 86.

As illustrated in FIG. 5, the upper trim 26 is attached to the stationary ceiling channel 86 to cover both the ceiling channel 86 and the moving top guide channel 92. The upper trim 26 includes a top wall 160 and a flange 162 that combine to receive and entrap a resilient mounting member 164. The mounting member 164 is supported along a support extrusion 166 that is spaced away from the vertical flange 88 of the ceiling channel 86 by a support arm 167. The combination of the top wall 160 and the flange 162 securely support the top trim 26, as illustrated.

Sidewall 168 of the top trim extends downward past the top guide channel 92 and is joined to a bottom wall 170. The bottom wall 170 extends horizontally and includes an open end 172 that receives and supports a resilient wiper 174. The wiper 174 contacts the outer face of the glass wall panel 12. As can be understood in FIGS. 5 and 6, as the height of the glass wall panel 12 is adjusted, the wiper 174 moves along the wall panel 12 since the upper trim 26 is stationary. In this manner, the wall panel 12 floats within the upper trim 26. In the preferred embodiment disclosed in FIGS. 5 and 6, the upper trim 26 is formed from an extruded metal material, such as aluminum.

Figure 7:
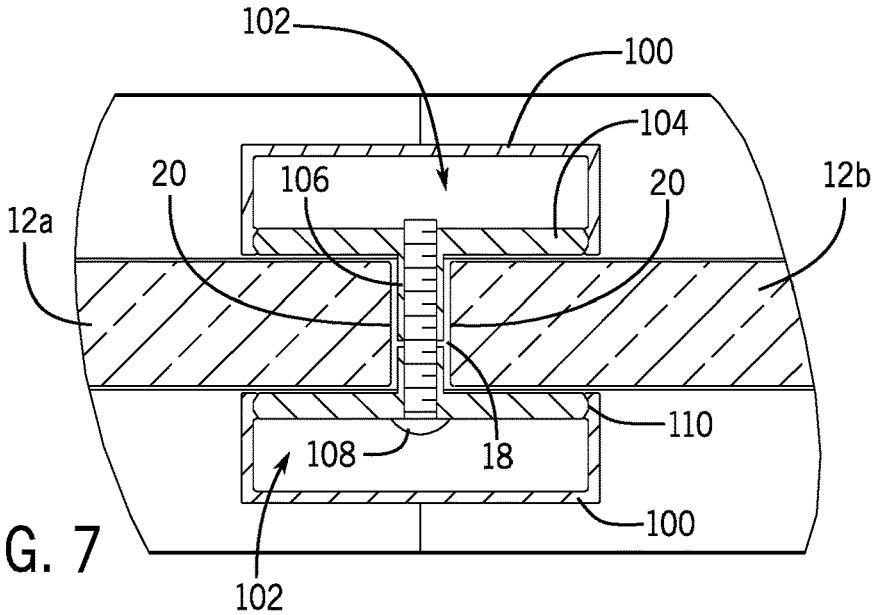
FIG. 7 is a section view illustrating one type of vertical trim attachment between adjacent glass wall panels.

FIG. 7 illustrates a first embodiment for attaching a section of vertical trim between adjacent glass wall panels 12*a* and 12*b*. As illustrated in FIG. 7, the side edges 20 of the adjacent wall panels 12*a*, 12*b* define a panel joint. As illustrated in FIG. 7, a vertical trim section 100 can be positioned on both sides of each of the glass wall panels 12*a*, 12*b* to cover the panel joint 18. In the embodiment shown in FIG. 7, a mounting bracket 102 is positioned on each side of the panel joint 18. Each of the mounting brackets 102 includes an attachment flange 104 and a center section 106. The center sections 106 extend into the panel joint 18 and includes a series of internal threads. The internal threads of each center section 106 receive a fastener 108. The fastener 108 is used to secure the pair of mounting brackets 102 on opposite sides of the wall panels 12*a*, 12*b*.

The outer edge of the attachment flange 104 for each of the mounting brackets 102 includes an attachment area 110. The attachment area 110 allows the vertical trim section 100 to snap into place along the mounting brackets, as illustrated. Several mounting brackets can be positioned along the height of the wall panels to provide spaced points of attachment for the vertical trim 100. The frictional fit between the vertical trim section 100 and the mounting bracket 102 allows the vertical trim section 100 to be easily positioned to cover the panel joint 18.

In the embodiment shown in FIG. 7, each of the wall panels 12*a*, 12*b* has a thickness of approximately ½ inch.

Based upon this thickness of the glass wall panel 12*a*, 12*b*, the vertical trim sections 100 simply cover the panel joint.

Figure 8:
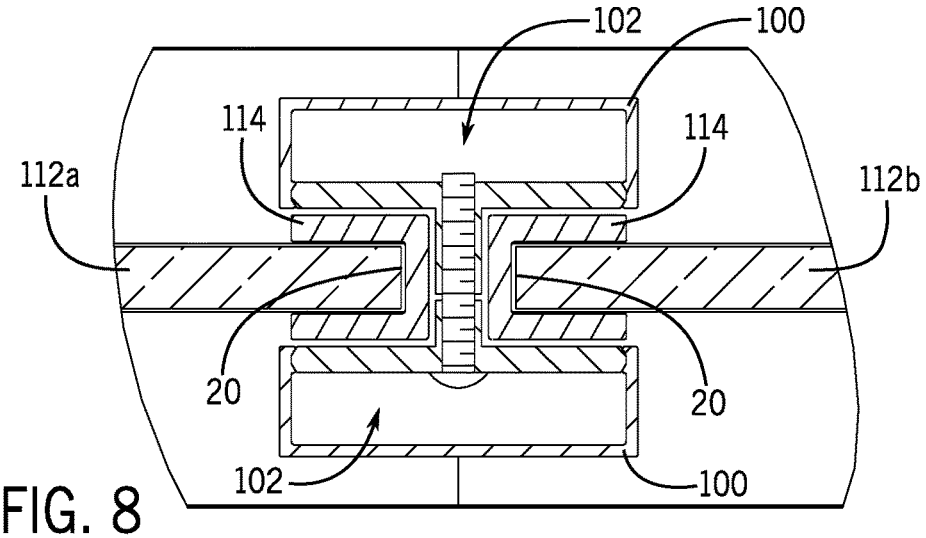
FIG. 8 is a section view illustrating the use of panel stiffening members between adjacent glass panels.

However, it is contemplated that the wall panel system could be utilized including wall panels 112*a* and 112*b* that have a reduced thickness, such as shown in FIG. 8. In FIG. 8, each of the wall panels 112*a*, 112*b* have a thickness of only ¼ inch thick glass. The use of thinner glass results in a cost savings but results in a glass panel that is typically not stiff enough to provide the required resistance to bending to transverse loads.

In the embodiment shown in FIG. 8, a stiffening channel 114 is attached to each of the vertical side edges 20 of the respective wall panel 12*a*, 12*b*. The stiffening channels 114 are connected only to the vertical side edges of the glass panels 112 to provide additional vertical strength for the thin wall panels 112*a*, 112*b*.

In the embodiment illustrated, each of the stiffening channels 114 is formed from a metallic material, such as steel or extruded aluminum.

Once the stiffening channels 114 are attached to each of the wall panels 112*a*, 112*b*, the mounting brackets 102 are used to provide a point of attachment for the vertical trim sections 100, as was the case in the embodiment of FIG. 7. Thus, the use of the stiffening channels 114 allow for the use of wall panels 112*a* and 112*b* that have a reduced thickness as compared to the embodiment shown in FIG. 7.

Figure 9:
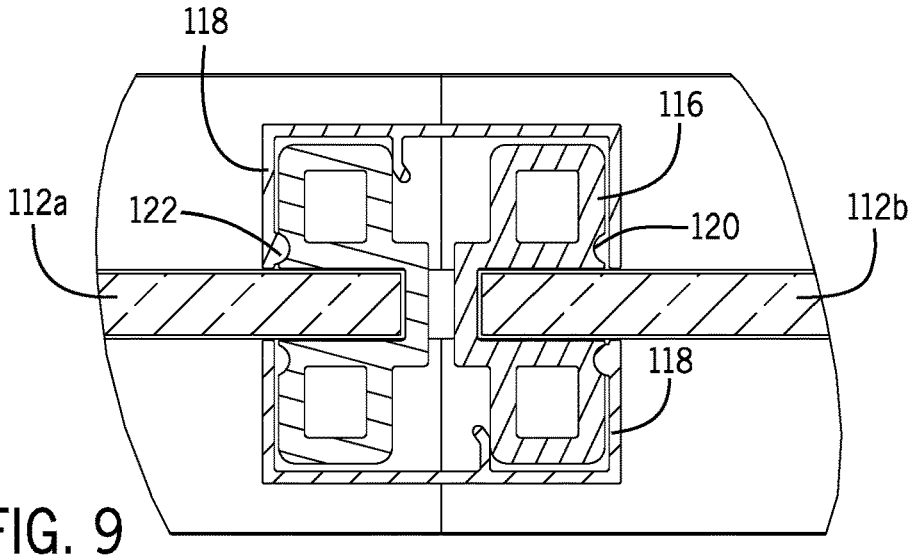
FIG. 9 is a section view illustrating another tile stiffening arrangement between glass panels.

FIG. 9 illustrates yet another embodiment of a stiffening channel that can be used. In the embodiment of FIG. 9, the stiffening channels 116 are each attached to one of the wall panels 112*a*, 112*b* to provide a point of attachment for the vertical trim section 118. In the embodiment shown in FIG. 9, each of the stiffening channels 116 includes a notch 120 that can receive a protruding bulb 122 to allow the trim section 118 to snap into place. The embodiment of FIG. 9 eliminates the requirement to utilize a separate mounting bracket, as in the embodiment shown in FIGS. 7 and 8. In both of the embodiments shown in FIGS. 8 and 9, the stiffening channels 114, 116 provide additional strength and rigidity for the ¼ inch glass wall panels 112.

Figure 10:
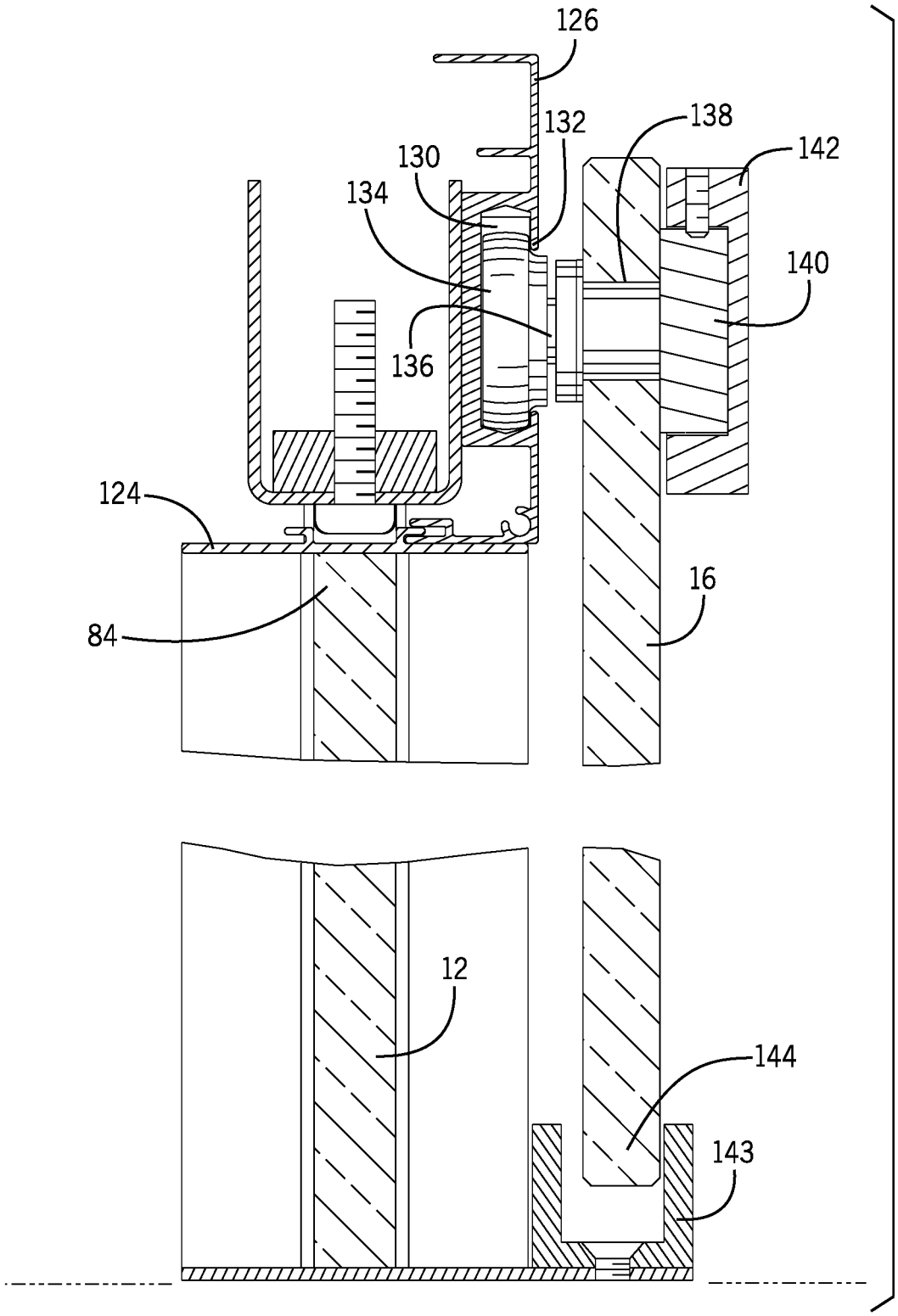
FIG. 10 is a section view illustrating the attachment of a sliding door track to the top trim section.

As stated in the description of FIG. 1, the demountable wall system 10 of the present disclosure can include a sliding door in addition to typical doors that mount on a pivot assembly. FIG. 10 illustrates one embodiment of mounting the sliding door 16 to cover an opening between two adjacent glass wall panels. As illustrated in FIG. 10, the top end 84 of the wall panel 12 includes a sliding door header 124 that extends between a pair of the wall panels 12. The sliding door header 124 receives and supports a sliding door track 126. The sliding door track 126 rests on the header 124 and is interlocked through an attachment slot 128. The sliding door track 126 defines a roller channel 130 that extends along the entire length of the sliding door track 126. Preferably, the sliding door track 126 extends both across the opening between adjacent wall panels as well as along one of the two adjacent panels to support the sliding door 16 in its open position. The roller channel 130 has an overall height that is greater than an opening 132 to the roller channel. The smaller opening 132 allows the roller channel 130 to entrap a series of rollers 134 within the roller channel 130.

As illustrated in FIG. 10, the roller 134 is supported along a shaft 136 which passes through an opening 138 formed near the top end of the sliding door 16. The shaft 136 is held within the opening 138 by an attachment member 140, which is surrounded by a trim piece 142. In the preferred embodiment of the disclosure, the sliding door track 126 is formed from an extruded metal, such as aluminum. The extruded metal sliding door track 126 allows the sliding door 16 to move between open and closed positions relative to the stationary wall panel.

As illustrated in FIG. 10, a lower door track 143 can be mounted to the floor to help retain and guide the bottom end 144.

Figure 11:
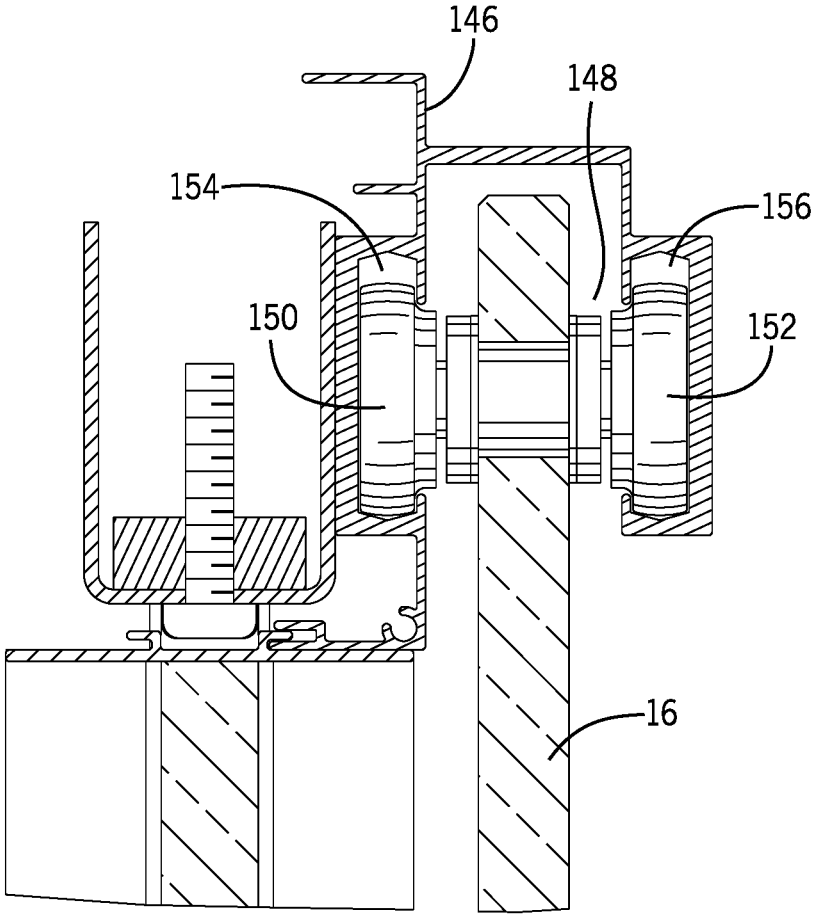
FIG. 11 is another view of an alternate embodiment of a sliding door track.
Figure 12:
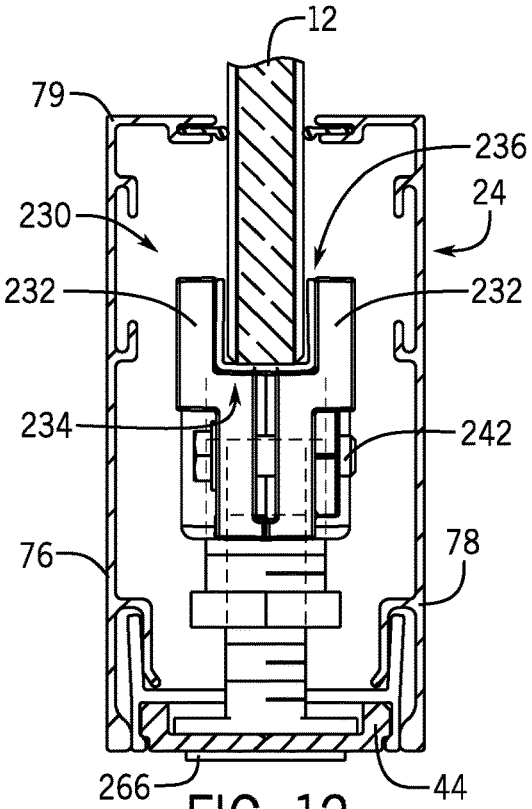
FIGS. 12-13 are section views of an alternate embodiment of the panel height adjustment mechanism shown positioned at two heights, similar to FIGS. 5-6.

FIG. 11 illustrates another, alternate embodiment of the sliding door track 146. In the embodiment shown in FIG. 11, the sliding door 16 includes a trolley 148 that includes a pair of rollers 150 and 152. The pair of rollers are each received within a separate roller channel 154, 156, respectively. As with the embodiment shown in FIG. 10, the sliding door track 126 is formed from an extruded metal material, such as aluminum.

Although the siding door shown in FIG. 1 does not extend to the full height of the wall panel, it is contemplated that sliding doors could be utilized that extends the full height of the wall panel 12. The reduced height sliding door 16 and the full height door (not shown) are supported by a similar sliding door track to allow the door to move between open and closed positions.

Additional embodiments according to the present disclosure are shown in FIGS. 12-15. The present inventors have identified that, in certain circumstances, it is advantageous for the panel height adjustment mechanisms 250 corresponding to a particular panel 12 to remain independent. The embodiment shown in FIGS. 12-15 depicts a demountable modular wall system 210 having a panel 12 that is mounted to one or more panel height adjustment mechanisms 250 directly, without integration of a separate bottom rail 30 as previously discussed. In this regard, FIGS. 12-15 disclose an alternative embodiment of a height adjustment mechanism 250 incorporated within a demountable modular wall system 210.

The embodiment of demountable modular wall system shown in FIGS. 12-15 includes a series of individual panels 12, as previously described. A movement direction is defined perpendicularly from the bottom end 28 to the top end 84 of the panel 12. A height adjustment mechanism 250 according to the present disclosure is positioned between the bottom end 28 of one of the individual panels 12 and the floor. The height adjustment mechanism 250 in certain embodiments is coupled to the floor via a floor channel 44, which was discussed above.

The height adjustment mechanism 250 has a mounting bracket 252 comprised of two separable halves 253A and 253B. In certain embodiments, these halves 253A and 253B are identical to one another. However, other embodiments provide halves 253A and 253B that are different from each other, for example having only one or the other of the halves 253A and 253B define fastener receivers 243 that are threaded for engaging with a fastener 242 to couple the halves 253A and 253B together. It should be recognized that the present disclosure anticipates many different types of fasteners known in the art, and further includes configurations in which the fastener receiver 243 is not threaded (for example, incorporating a nut to engage a bolt as the fastener 242, after the fastener has extended through both halves 253A and 253B of the mount bracket 252).

The mounting bracket 252 has support flanges 232 and a bottom wall 234 that together form an open receiving cavity 236. In this manner, the mounting bracket 252, particularly the support flanges 232, sandwich the bottom end 28 of the panel 12. In certain embodiments, the mounting bracket 252 becomes rigidly coupled to the bottom end 28 of the panel 12 when the halves 253A and 253B are coupled together. In this manner, adjusting the height of the panel 12 in the presently disclosed system also results in adjusting the height of the mounting bracket 252. In further embodiments, seals or elements providing friction between the panel 12 and the support flanges 232 are also provided. The mounting bracket 252 further defines a receiving cylinder 256 configured for coupling the mounting bracket 252 with a height adjustment mechanism 250, which is discussed further below.

The height adjustment mechanism 250 incorporates a double jack screw 280. In certain embodiments, the double jack screw 280 is the same double jack screw discussed above (for example with respect to the system shown in FIG. 2). The double jack screw 280 allows the overall height of the panel 12 to be adjusted, while also minimizing the height of the double jack screw 280 when fully retracted. In the embodiment shown, the double jack screw 280 includes a stud, also referred to as a second member 264, that is stationary and attached to the floor (such as via floor channel 44) by a fastener. In further embodiments, the fastener 66 prevents the second member 264 from rotating. However, other techniques for coupling or otherwise fixating the height adjustment mechanism 250 relative to the floor are also anticipated by the present disclosure.

Similar to the system shown in FIG. 2 and discussed above, the height adjustment mechanism includes a second member 264 with a shaft 268 that, in the present embodiment, has external threads. The external threads of the shaft 268 are received within an internally threaded open interior of an upper jack screw, also referred to as the first member 270. The first member 270 also includes an externally threaded shaft 272 that is threaded in the opposite hand from the second member 264. The shaft 272 of the first member 270 is received by the internally threaded open interior 262 of the receiving cylinder 256, which as previously described is defined within the mounting bracket 252. In this manner, the height between the bottom end 28 of the panel 12 and the floor can be modified by rotating the first member 270, such as via the hexagonal exterior surface 273. While other shapes are also anticipated by the present disclosure, the hexagonal exterior surface 273 can be easily engaged with a common wrench to adjust the height of the panel 12 with the height adjustment mechanism 250. Moreover, the present inventors have identified that the design of the height adjustment mechanism 250 is simplified by configuring the first member 270 to be rotatable about an axis parallel to the movement direction of the panel 12.

By threading the second member 264 and the shaft 272 of the first member 270 to be opposite handed, rotation of the first member 270 results in both movement of the first member 270 relative to the floor (via engagement between the first member 270 and the shaft 268 of the threaded second member 264), and movement of the mounting bracket 252 relative to the first member 270 (via engagement between the receiving cylinder 256 and the shaft 272 of the first member 270). Therefore, this double threaded arrangement of the height adjustment mechanism 250 creates a total stroke that is greater than twice the height of the height adjustment mechanism 250 when completely retracted. This configuration allows for a greater range of motion, simply adjustment, and simplified construction, all while minimizing the size of the height adjustment mechanism 250.

Figure 13:
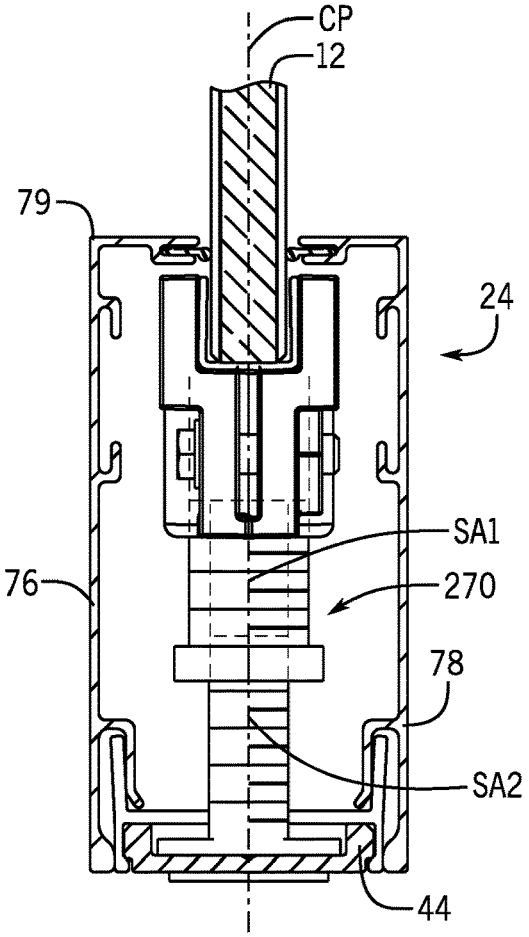
Figure 14:
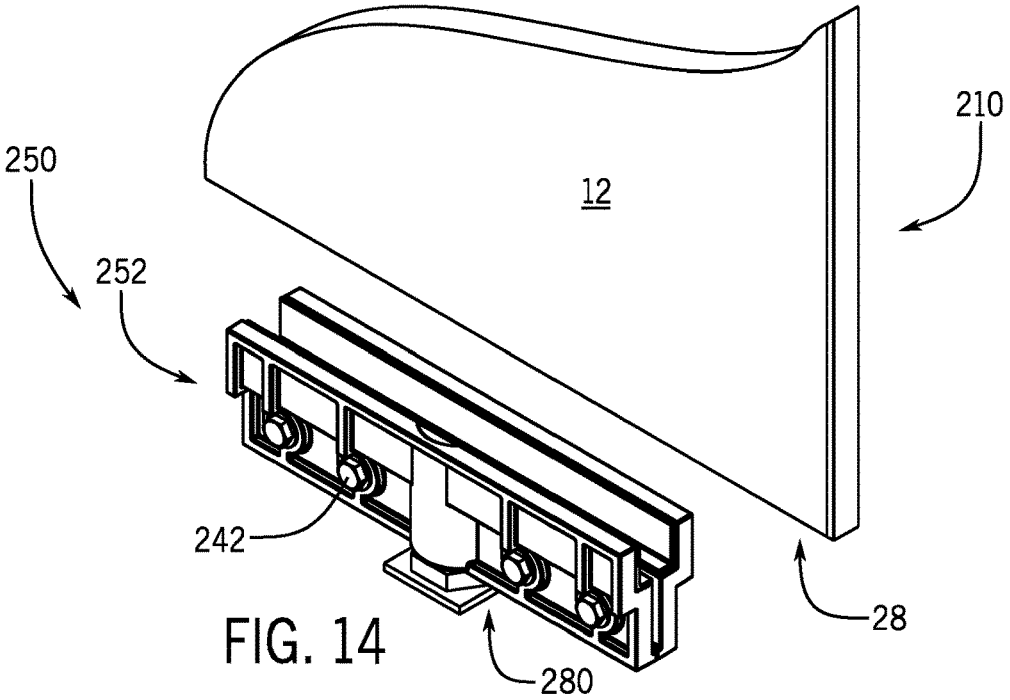
FIG. 14 is an isometric view of the panel height adjustment mechanism from FIGS. 12-13 with the glass wall panel removed.
Figure 15:
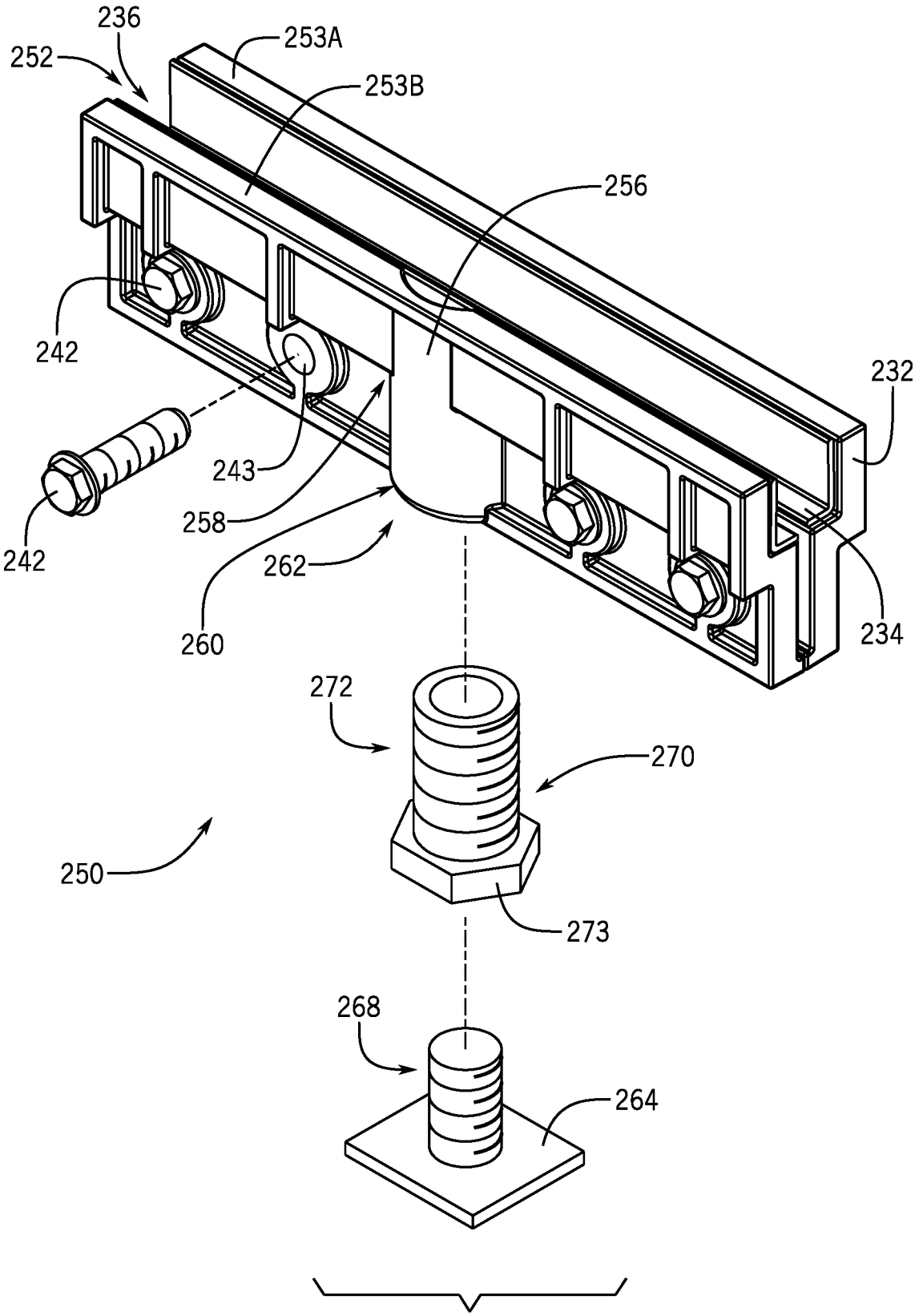
FIG. 15 is a partially exploded view of the panel height adjustment mechanism shown in FIG. 14.

As best shown in FIG. 13, the panel 12 further defines a central plane CP between the first side and the second side that is parallel to the first side. Likewise, the first member 270 and the shaft 268 define shaft axes SA1 and SA2, respectively. In certain embodiments, the shaft axis SA1 and the shaft axis SA2 are coaxial, such as that shown in FIG. 13. Moreover, in certain embodiments, one or both of the shaft axis SA1 and shaft axis SA2 are within the central plane CP.

In certain embodiments, the demountable modular wall system 210 incorporates two height adjustment mechanisms 250 for each individual panel 12. These two height adjustment mechanisms 250 are not directly coupled together, allowing each to be independently adjusted as necessary to support the panel 12. For example, an uneven floor may require one of the two height adjustment mechanisms 250 to be adjusted or set higher than the other to provide a level panel 12 (i.e, a level bottom end 28).

It should be recognized that other numbers of height adjustment mechanisms 250 per panel 12 (both greater and fewer) are also anticipated by the present disclosure. For example, certain panels 12 may be sufficiently supported from below by a single height adjustment mechanism 250, which in certain cases would be located centrally. This may particularly apply where adjacent panels 12 are coupled by other means, such as with vertical trim sections 100 as previously described. In contrast, other panels 12, particular those having great weight, may require more than two height adjustment mechanisms 250 to safely support and immobilize the panel 12. In each case, the height adjustment mechanisms 250 are configured to permit independent adjustment, both before and after the respective mounting brackets 252 are securely coupled to the corresponding panel 12.

Further embodiments of the present disclosure also relate to alternative top channel guides 92 for supporting the top end of a panel 12. A previous embodiment of top channel guide 92 was shown and discussed with respect to FIGS. 5 and 6. In the present embodiment, which is now shown in FIGS. 16 and 17, the top channel guide 92 once again defines an open passageway 90 for receiving a top end of one of the panels to be securely attached thereto. In the present embodiment, the top channel guide 92 comprises a first portion 97A and a second portion 97B that are rotatably coupled via rotatable locking feature 200. The top channel guide 92 is rotatable between an open state shown in FIG. 16 and a closed state shown in FIG. 17, whereby in the closed state the open passageway 90 is narrower than in the open state. In this manner, the top channel guide 92 is securely attached to one of the panels 12 when the panel 12 is received within the open passageway 90, and the top channel guide 92 is rotated into the closed state. It will be recognized that engagement between the top channel guide 92 and the ceiling channel 86 (see FIGS. 5-6) prevents the top channel guide 92 from rotating out of the closed state, thereby locking the top guide channel 92 onto the panel 12.

Figure 17:
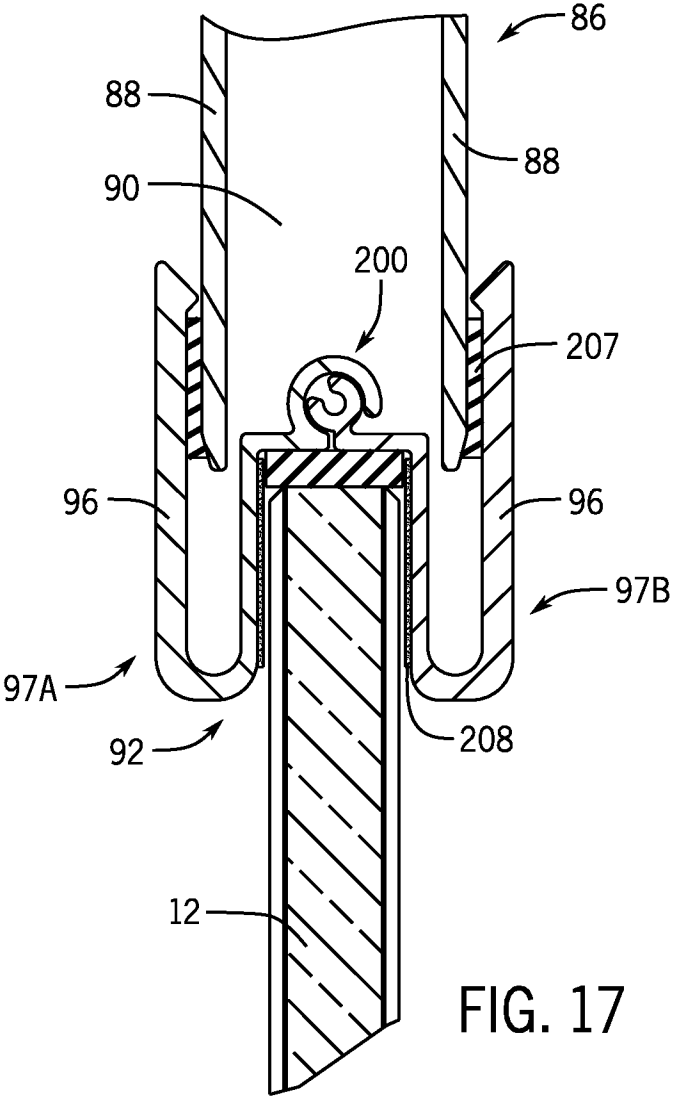
FIGS. 16-17 depict an alternate embodiment of a top channel guide for securing the top end of a panel.
Figure 16:
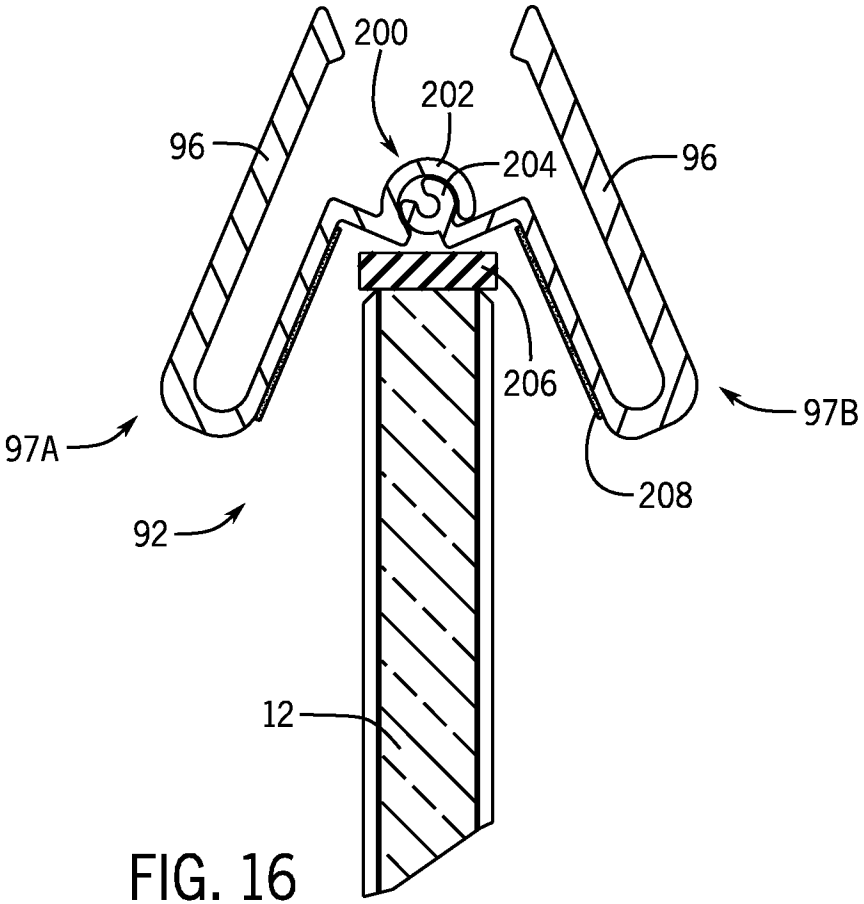

In certain embodiments, additional materials are provided between the panel 12 and the top channel guide 92, as also discussed above. For example, FIGS. 16 and 17 depict the incorporation of a material 206 positioned on the top end of the panel 12, whereby the top channel guide 92 rests upon this material 206. As previously discussed, the material 206 may be a flexible material or an adhesive, which may assist in the process of coupling the top channel guide 92 to the panel 12, provide cushioning therebetween, and/or offer other benefits. FIG. 17 further includes materials 207 between the vertically extending side arms 96 of the top guide channel 92 and the flanges 88 of the ceiling channel 86. The materials 207 may be the same or different than the material 206, and likewise may offer the same or different benefits.

Likewise, the embodiment depicted in FIGS. 16 and 17 includes a material 208 that is coupled to the top channel guide 92 and configured to contact the panel 12 received within the open passageway 90 when the top channel guide 92 is in the closed state. In the present embodiment, the material 208 is an adhesive material that assists in securely coupling the top channel guide 92 to the panel 12.

FIGS. 16 and 17 further depict an embodiment of the top channel guide 92 in which the rotatable locking feature 200 comprises an exterior component 202 that is rigidly coupled to the first portion 97A, and an interior component 204 that is rigidly coupled to the second portion 97B. These may be integrally formed, or subsequently coupled through methods known in the art. As shown, the interior component 204 is rotatably received within the exterior component 202 to provide rotation of the rotatable locking feature 200. In the present example, the exterior component 202 and interior component 204 each comprise a "C" shape, though other configurations are also anticipated, including the interior component 204 being of circular cross sectional shape. In this manner, the interior component 204 is nestable within the exterior component 202 by insertion in the axial direction, whereby the exterior component 202 then limits the rotation of the interior component 204 therein, also restricting any other lateral movement therebetween.

It should be recognized that the top channel guide 92 shown in FIGS. 16 and 17 may be used to support the top end of a wide variety of panels 12, and may be used with or without the addition of a panel height adjustment mechanism. Moreover, the presently disclosed top channel guide 92 is usable with a wide variety of panel height adjustment mechanisms, including the panel height adjustment mechanisms 50 shown in FIGS. 2-6, and/or the panel height adjustment mechanisms 250 shown in FIGS. 12-15.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A demountable modular wall system for use in a building having a floor and a ceiling, comprising:

a series of individual panels each having a first side, a second side, a top end, and a bottom end, a movement direction being defined perpendicularly from the bottom end to the top end;

a height adjustment mechanism that is positioned between the bottom end of one of the individual panels and the floor, the height adjustment mechanism having a mounting bracket with a first member flange and a second member flange that together sandwich the bottom end of the one of the individual panels, wherein the height adjustment mechanism includes a receiving cylinder that threadingly engages with a first member, the first member threadingly engaging with a second member positioned between the first member and the floor, wherein the first member is moveable relative to the receiving cylinder in the movement direction such that rotation of the first member selectively adjusts the height of the one of the individual panels; and an upper trim positioned between the top end of each of the individual panels and the ceiling and a lower trim positioned between the bottom end of each of the individual panels and the floor, wherein the upper and lower trim are stationary relative to the individual panels.

2. The demountable modular wall system according to claim 1, wherein the first member and the second member are coaxially aligned.

3. The demountable modular wall system according to claim 1, wherein the receiving cavity has internal threads, wherein the second member has external threads, and wherein the first member has external threads that engage with the internal threads of the receiving cavity and internal threads that engage with the external threads of the second member.

4. The demountable modular wall system according to claim 1, wherein the first member has a hexagonal exterior surface configured to be engaged by a wrench to rotate the first member.

5. The demountable modular wall system according to claim 1, wherein the one of the individual panels is glass.

6. The demountable modular wall system according to claim 1, wherein rotation of the first member also adjusts the height of the mounting bracket.

7. The demountable modular wall system according to claim 1, wherein the height adjustment mechanism is a first height adjustment mechanism, further comprising a second height adjustment mechanism that is positioned between the bottom end of the one of the individual panels and the floor, the second height adjustment mechanism having a mounting bracket with a first member flange and a second member flange that together sandwich the bottom end of the one of the individual panels, wherein the second height adjustment mechanism includes a receiving cylinder that threadingly engages with a first member, wherein the first member threadingly engages with a second member positioned between the first member and the floor, wherein the first member is moveable relative to the receiving cylinder in the movement direction such that rotation of the first member selectively adjusts the height of the one of the individual panels, wherein the first height adjustment mechanism and the second height adjustment mechanism are independently adjustable.

8. The demountable modular wall system according to claim 7, wherein the series of individual panels further comprises a second of the individual panels, further comprising a third height adjustment module identical to the first height adjustment module and a fourth height adjustment module identical to the second height adjustment module, wherein the third height adjustment module and the fourth height adjustment module are each configured to independently adjust the height of the second of the individual panels, and wherein the height of the one of the individual panels is independent of the height of the second of the individual panels.

9. The demountable module wall system according to claim 7, wherein the first height adjustable module is identical to the second height adjustment module.

10. The demountable module wall system according to claim 1, wherein the first member has a shaft axis that is parallel to the movement direction, wherein the one of the individual panels defines a central plane between the first side and the second side that is parallel to the first side, and wherein the shaft axis is within the central plane.

11. The demountable modular wall system according to claim 1, wherein two of the series of individual panels are positioned adjacent to each other such that side edges of the two of the series of individual panels abut each other to define a panel joint, further comprising a vertical trim section coupled to the mounting bracket to conceal the panel joint.

12. The demountable modular wall system according to claim 11, wherein the vertical trim section is held in place on the mounting bracket by a friction fit.

13. The demountable modular wall system according to claim 1, wherein the one of the individual panels has a thickness of approximately ¼ inch.

14. A demountable modular wall system for use in a building having a floor and a ceiling, comprising:

a series of individual panels each having a first side, a second side, a top end, and a bottom end, a movement direction being defined perpendicularly from the bottom end to the top end;

a pair of height adjustment mechanisms for each of the individual panels, each of the height adjustment mechanisms being positioned between the bottom end of one of the individual panels and the floor, each of the height adjustment mechanisms having a mounting bracket with a first member flange and a second member flange that together sandwich the bottom end of the one of the individual panels, wherein each of the height adjustment mechanisms includes a receiving cylinder that threadingly engages with a first member, wherein the first member threadingly engages with a second member positioned between the first member and the floor, wherein the first member is moveable relative to the receiving cylinder in the movement direction such that rotation of the first member selectively adjusts the height of the one of the individual panels, and wherein each of the height adjustment mechanisms is independently adjustable; and an upper trim positioned between the top end of each of the individual panels and the ceiling, and a lower trim positioned between the bottom end of each of the individual panels and the floor, wherein the upper and lower trim are stationary relative to the individual panels.

15. The demountable modular wall system according to claim 14, wherein the first member and the second member are coaxially aligned.

16. The demountable modular wall system according to claim 15, wherein each receiving cavity has internal threads, wherein each second member has external threads, and wherein each first member has external threads that engage with the internal threads of the receiving cavity and internal threads that engage with the external threads of the second member.

17. The demountable modular wall system according to claim 16, wherein rotation of the first member also adjusts the height of the mounting bracket.

18. A demountable modular wall system for use in a building having a floor and a ceiling, comprising:

a plurality of panels each having a top end and a bottom end; and a top channel guide that defines an open passageway for receiving the top end of one of the panels to be securely attached thereto, wherein the top channel guide comprises a first portion and a second portion that are rotatable coupled via a rotatable locking feature to define the open passageway therebetween, the top channel guide is rotatable between an open state and a closed state in which the open passageway is narrower than in the open state;

wherein the top channel guide is securely attached to the one of the panels when the one of the panels is received within the open passageway and the top channel guide is in the closed state.

19. The demountable modular wall system according to claim 18, wherein the rotatable locking feature comprises an exterior component rigidly coupled to the first portion and an interior component rigidly coupled to the second portion, and wherein the interior component is receivable within the exterior component and rotatable therein.

20. The demountable modular wall system according to claim 18, wherein the top channel guide further comprises an adhesive material, wherein the adhesive material is configured to contact the one of the panels when the one of the panels is received within the open passageway and the top channel guide is in the closed state.

* * * * *